United States Patent [19]

Spies

[11] 4,026,336

[45] May 31, 1977

[54] DISPENSING APPARATUS

[76] Inventor: Henry J. Spies, 6165 Estes St., Arvada, Colo. 80004

[22] Filed: Nov. 24, 1975

[21] Appl. No.: 634,416

[52] U.S. Cl. ..... 141/348; 222/514

[51] Int. Cl.[2] ..... B65B 3/04

[58] Field of Search ..... 141/353–361, 141/348, 302, 291–295; 222/513, 514, 501, 559, 181, 564, 322, 246, 449

[56] References Cited

UNITED STATES PATENTS

| | | | |
|---|---|---|---|
| 2,761,606 | 9/1956 | Pahl et al. | 141/354 X |
| 3,072,299 | 1/1963 | Sessions et al. | 222/181 X |
| 3,240,430 | 3/1966 | Diamond | 141/352 X |
| 3,307,595 | 3/1967 | Berning et al. | 141/348 X |
| 3,370,909 | 2/1968 | Schwartzman | 222/501 X |
| 3,373,776 | 3/1968 | Kajita | 141/292 X |
| 3,402,747 | 9/1968 | Tossot-Dupont | 141/352 X |
| 3,476,507 | 11/1969 | Leeds | 141/348 X |
| 3,680,605 | 8/1972 | Nigro | 141/348 X |
| 3,885,608 | 5/1975 | Ayres | 141/354 |

*Primary Examiner*—Stanley H. Tollberg
*Assistant Examiner*—N. L. Stack, Jr.
*Attorney, Agent, or Firm*—John E. Reilly

[57] ABSTRACT

Loose materials capable of fluidic flow are transferrable from a container via a neck or spout assembly which includes coaxially telescoping tubular members with the inner member having specially designed sidewall ports in communication through the inner member into the interior of the container to which the neck assembly is attached. The outer tubular member is biased so as to normally overlie the ports in closing relation. The neck assembly is adapted for use in transferring the materials into another container in which the other container includes an access opening in a lid or endwall dimensioned to permit passage of the inner tubular member of the neck assembly while blocking passage of the outer tubular member thereby permitting opening of the ports. The second container assembly can also include a resiliently biased plug mounted interiorly thereof for normally closing the access opening.

14 Claims, 5 Drawing Figures

DISPENSING APPARATUS

BACKGROUND OF THE INVENTION

The present invention relates to apparatus and methods for dispensing flowable materials securely within containers and is particularly designed for use in dispensing granular or powdered materials. More particularly, the present invention relates to apparatus and methods for transferring flowable materials between containers in a manner which permits sealed isolation of the bulk storage container during both transferring and non-transferring usage. Although not necessarily limited thereto, the present invention is particularly useful for securely storing loose dry materials such as salt, pepper, sugar, flour and the like while permitting dispensing of those materials from a storage container to a receptacle container.

Various arrangements have been suggested in the prior art for bulk storage of flowable materials in a manner which permits rapid dispensing thereof into another container. For instance, plunger-type actuating pistons which seal the bulk container but permit gravity feed therethrough when the plunger piston is urged inwardly are shown in U.S. Pat. Nos. 3,042,085 by Morris, 3,061,152 by Safianoff et al., and 3,232,498 by Bennett. Such devices are an improvement for controlled dispensing purposes and generally accommodate some external securing of the bulk stored contents. However, they require the availability of special storage containers and are not well suited for attachment to existing containers such as those used for bulk shipment of products. In addition, such prior art devices require separate closure caps or the like if the dispensed materials are to be isolated from the environment after discharge from the bulk storage device. Further, telescoped tubular arrangements have been suggested for liquid dispensing nozzles such as in U.S. Pat. Nos. 1,946,314 by Desmond and 3,324,904 by Crothers. Such liquid dispensing nozzles employ the telescoped tubular members so that holes therethrough are exposed to permit liquid dispensing either by sliding the outer tubular member onto the inner member so that holes through both members align as with Desmond or by axially moving the outer member so as to expose holes into the inner member interior as with Crothers. Such devices are not well suited for dry material transfer nor are they adaptable for use with unmodified existing bulk storage containers. Additionally, such prior art devices require external exposure of the closure biasing springs and are subject to flow blockage when used for dry material transfer instead of liquid material transfer. Furthermore, as with the other prior art devices, Crothers and Desmond likewise require removal and replacement of a separate sealing cap in the receiving container in order to be effective for external isolation.

Despite the prior art developments, there has been a continuing need for devices which can be used in association with existing bulk storage containers so as to permit reliable transfer of flowable dry materials from those containers into other containers with secure external isolation of the storage container during material transfer as well as when not in use. Still further, there has been a continuing need for dispensing storage containers and receptacle containers which will cooperate to automatically seal both containers from the external environment while simply and reliably cooperating for establishing flow transfer therebetween in a manner which minimizes potential spillage loss during the transfer operation. The need for such devices is particularly evident for restaurant environments and the like where salt and pepper shakers, sugar condiments and the like must be regularly recharged from bulk storage containers.

SUMMARY OF THE INVENTION

In accordance with the present invention, internal communication between two containers for effecting flowable material transfer therebetween is obtained by a neck or spout assembly on one container which matingly cooperates with an opening in the receiving container to establish externally isolated flow therebetween but with this spout assembly being self-contained for automatically sealing the bulk storage container when disengaged. As will be described in greater detail for the exemplary preferred embodiments below, the container with the pouring spout or dispenser assembly attached thereto can cooperate with a spring-loaded cap or other normally closed access opening in the other container. The apparatus supports material flow transfer in either direction and the primary utility is anticipated as being for use with loose dry material transfer. The neck or spout assembly projects outwardly from the container to which it is attached and includes telescoping or concentrically positioned, elongated hollow members. The inner member is stationary relative to the container and has a closed outer end with at least one port or orifice through the sidewall near the closed end. The closed end can include a wedge portion with inwardly directed sloping surfaces for deflecting material flow into the ports. The other end of the inner member may be secured for extension through or into an existing opening in the container so that the interior of the container on which it is mounted can be in open communication through the port. The other elongated hollow member slidingly fits over the stationary member so as to be positioned in normally closed relation to the port. A resilient biasing means is positioned for urging the slidable member into the port closing position. The sliding member includes a stop for preventing further travel once the port closing position is attained.

An additional elongated hollow member can be attached in fixed relation around the stationary member as a shroud. This shroud member defines a cylindrical chamber between it and the inner member for retaining the resilient biasing means as well as for providing an outer extension stop for the sliding member.

The other container has an opening through one wall thereof dimensioned for allowing passage therethrough of the inner hollow member on the neck assembly while blocking passage of the outer sliding hollow member. Although the second container opening can be normally closeable by a separate cover or even be normally open, it preferably includes an internally mounted plug dimensioned for closing the hole through the wall with the plug mounting means yieldingly urging the plug into closing relation with respect to the hole. Accordingly, open communication is established between the container interiors for material transfer flow therebetween by forcing the neck assembly against the wall of the second container so that the plug is forced internally into the second container while the inner hollow member protrudes through the second container hole so as to open the sidewall orifices into flow supporting relation.

Both closure assemblies on the containers are easily attached but effect secure retention of the container contents other than during the transfer operation. However, even during the transfer operation, the interior of both containers is effectively isolated thereby reducing material loss hazards. The apparatus is particularly well-suited for incorporating the receiving or plug-type arrangement within the otherwise conventional lid of a receptacle such as a salt shaker, sugar condiment, syrup or other liquid material dispensing container or the like.

An object of this invention is to provide a novel and improved arrangement for securely retaining flowable materials within a storage container while permitting establishment of isolated transfer between concontainers.

Another object of this invention is to provide a novel and improved structure for providing external sealing of containers while further permitting externally sealed content transferral between those containers.

A further object of this invention is to provide a novel and improved structure for permitting rapid but secure transferal of flowable materials between containers through a simple manual operation but which further effects secure isolation of the internal contents of both containers when used for other than transferal purposes.

Yet another object of this invention is to provide a novel and improved structure for effecting external isolation of containers requiring periodic secured flowable material transfer therebetween in a manner which automatically effects external isolation at all times including the duration of transferal operations but which further is easily adapted for attachment to existing containers.

The foregoing and other objects, features and advantages of the present invention will be more readily apparent in light of the following detailed description of exemplary embodiments.

DETAILED DESCRIPTION OF THE PREFERRED EMBODIMENTS

Figure 1:
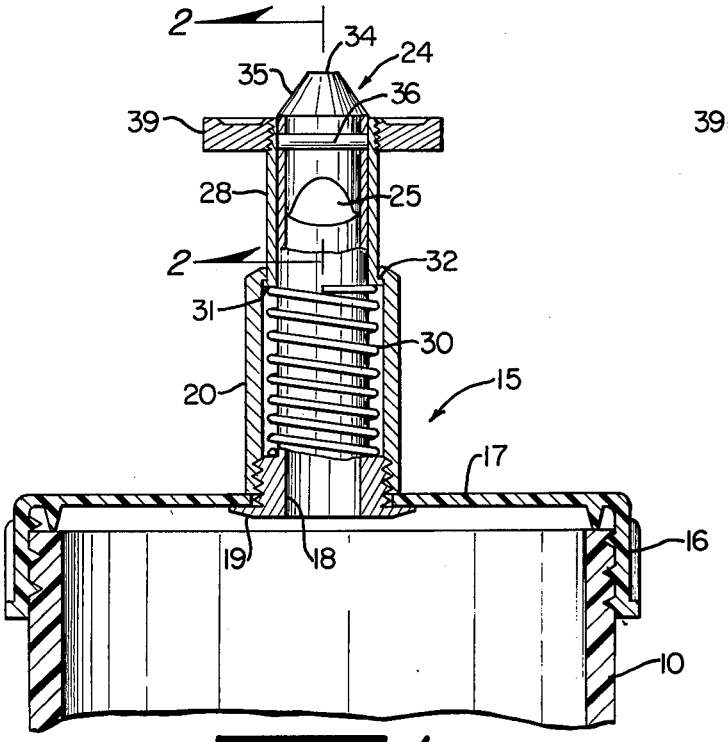
FIG. 1 is a side, partially sectioned and broken view of a container having attached thereto a spout or neck assembly in accordance with the preferred embodiment.

The preferred embodiments of this invention will be described as a system for injection of condiments between bulk storage containers and dispensers. The invention is particularly useful for transfer of salt or pepper into shakers, bulk sugar or flour into dispensers and the like, but also is equally applicable for transfer between containers of a variety of flowable materials. The invention is employed for transferring flowable materials from a bulk storage container 10 into a conventional container which can be either unmodified or provided with a specially designed self-sealing structure as shown for container 12 in FIG. 3 with alternate attachments shown in FIGS. 4–5. Bulk storage container 10 has a neck or pouring spout assembly 15 threadedly attached to the upper end 17 of cap 16 which is in turn threaded onto the top of container 10. Spout assembly 15 can likewise be adapted as a self-contained unit which is threaded into an existing tapped hole in container 10 or attached to an unthreaded hole in a generally similar manner as is illustrated in FIG. 1.

Assembly 15 includes a hollow cylindrical inner sleeve 18 which has a flange 19 for fitting within the hole through the upper sidewall 17 of the attaching cap 16. Threads extend upwardly on the lower shank of sleeve 18 through the hole in wall 17 for engaging an outer cylindrical member 20. Thus inner sleeve 18 is rigidly mounted as a stationary upward extension from container 10 and terminates in an upper closed end cap assembly 24. A pair of diametrically opposed ports or openings 25 and 26 [note FIG. 2] extend through the end of sleeve 18 in proximity to closed end 24 so as to provide open communication between the interior thereof through sleeve 18. As thus attached, outer member 20 is secured in spaced but surrounding relation to inner member 18 between the container surface 17 and ports 25 and 26. Thus the outer surface of member 18 and the inner surface of member 20 defines a circumferential chamber 22 therebetween.

Figure 2:
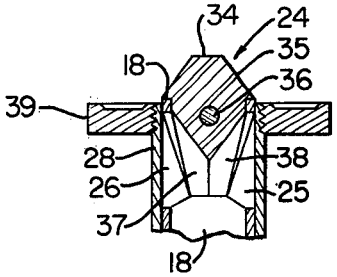
FIG. 2 is a sectioned and partly broken view taken along line 2—2 of FIG. 1.

As shown in FIGS. 1 and 2, an intermediate hollow cylindrical sleeve 28 slidably surrounds inner sleeve 18 and is normally biased into closing surrounding relation to ports 25 and 26 via spring 30 within chamber 22. That is, spring 30 is concentrically mounted in the space 22 between inner sleeve 18 and fixed outer sleeve 20 so as to apply an outwardly biasing force to the radial end flange or lip 31 on sleeve 28 thereby forcing it outwardly until it engages the inward radially extending shoulder 32 of sleeve 20. Thus shoulder 32 and flange 31 cooperate to establish a limiting stop for outward movement of slidable member 28. The limit stop function could be provided without shroud member 20 by other means such as by including a slot or slots through slide member 28 parallel to its axis and a pin or pins extending from stationary member 18 into those slots.

Figure 3:
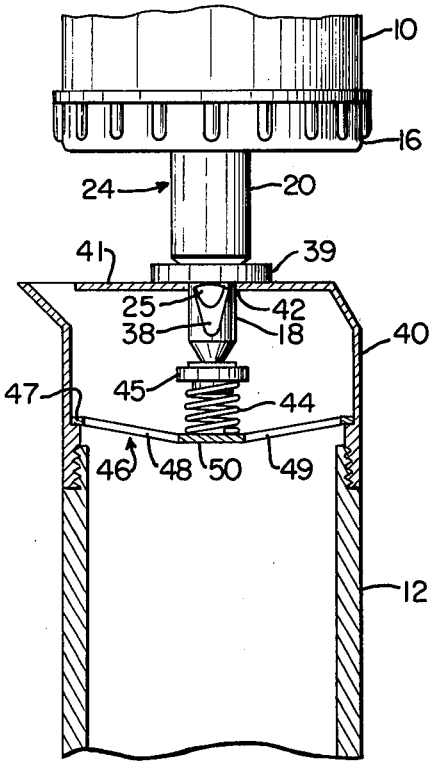
FIG. 3 is a section view of a receiving container assembly shown in transferal relation to a spout or neck assembly on a container as shown in FIG. 1.

The end cap assembly 24 includes a central portion 35 retained in place by pin 36 extending between the sidewalls at the end of cylindrical member 18. Cap 35 includes appropriately sloped surfaces such as 37 and 38 for outwardly urging flowing materials from the hollow interior of cylindrical member 18 through ports 25 and 26 as is shown in FIGS. 2 and 3. However, sleeve 28 is normally biased in closing relation around the ports 25 and 26 via spring 30 when bulk container 10 is not being used for material transfer to a second container 12.

Intermediate cylinder 28 has a collar 39 threadedly attached to the external end thereof. Thus, by applying an axial force to collar 39 toward container 10, sleeve 28 is retracted inwardly so as to externally expose ports 25 and 26 and permit discharge of the contents from container 10 into another container such as 12 and as is particularly illustrated in FIG. 3 wherein actual transfer is established via gravity flow. As will be more fully appreciated from the subsequent description, it is only necessary that the outer diameter of the end 24 of inner member 18 be capable of passing through a circular opening in the receiving container while the outer end surfaces of slidable member 28 be such as to prevent its passage through the receiving container opening. However, addition of a collar 39 to the end of member 28 is particularly advantageous in that it permits use of the spout assembly for transferring materials into receiving containers having different opening diameters. For instance, container 10 can be used for charging shaker condiments having relatively large openings when their caps are removed but container 10 can still be used to fill other containers with a self-sealing adaptor as shown in FIGS. 3–6 despite the smaller diameter openings thereof and without modification or change to the dispensing spout assembly 15.

The receiving container 12 of FIG. 3 threadedly receives cap 40 on the upper portion thereof. The upper wall 41 of cap 40 has a hole 42 therethrough and a plug or button 45 is arranged to be normally biased via spring 44 into sealing engagement with hole 42. The spring 44 and plug 45 are internally retained within cap 40 by means of an open web arrangement 46 which includes an outer concentric ring 47 and a plurality of extension arms 48 and 49 for retaining a central portion 50 in axial alignment with hole 42. Thus web 46 can be constructed as a snap-in type of assembly.

In use, bulk container 10 is inverted as shown in FIG. 3 with the end of sleeve 18 aligned with plug 44. Application of downward pressure on container 10 then causes cylindrical member 18 to force plug 45 inwardly against the bias of spring 44 and the open web or cage assembly 46 until the sidewall ports 25 and 26 are internally exposed within the interior of container 12. This is effected by engagement of the upper surface of wall 41 against collar 39 thereby forcing cylinder 28 upwardly against spring 30 until member 18 extends interiorly to container 12 as shown in FIG. 3. The contents of container 10 are then gravity fed into container 12.

Figure 4:
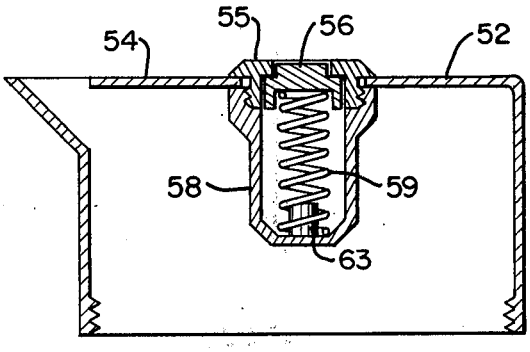
FIG. 4 is a sectioned view of the upper end of a receiving plug assembly illustrating another mounting arrangement therefor.
Figure 5:
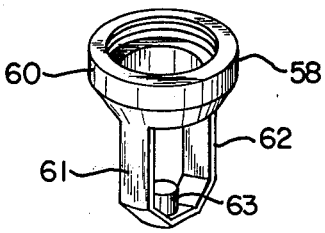
FIG. 5 is a perspective view of the mounting web for the FIG. 4 embodiment.

FIG. 4 shows an alternate open web or cage assembly useful in conjunction with a receiving container such as container 12 of FIG. 3. As shown in FIGS. 4 and 5, a cap 52 is attached to the container via a conventional thread arrangement on the lower end and has a central hole extending through upper wall 54. A threaded collar 55 extends through this hole and is arranged to engage open cage 58 so as to retain plug 56 internally therein. That is, cage 58 is composed of upper concentric ring section 60 which is internally threaded to mate with collar 55. Cap 58 further includes downwardly extending arms 61 and 62 which join in a central portion for retaining nub 63 in proper alignment for spring 59. Thus, a plug 56 seals the opening through collar 55 in response to the axial biasing of spring 59 as is clearly shown in FIG. 4. Note that downward axial pressure against plug or button 56 by the end of the cap assembly 24 will permit passage of the lower or port end of tube 18 into the interior of the container on which cap 52 is attached for material transfer therebetween substantially as described heretofore. That is, the upper shoulder of collar 55 engages the threaded collar 39 on coaxially slidable tube 28 so as to force it toward the wall 17 of the cap 16. Note that collar 39 can include an inner recess for receiving the edges of collar 55 to aid in aligning inner cylinder 18 with plug 56.

As shown in FIG. 4, the inner surfaces of side arms 61 and 62 are dimensioned for effectively guiding plug 56 so as to prevent any lateral movement thereof as it is forced inwardly into the receptacle container. However, it has been found that the substantially flat end face 34 of cap assembly 24 provides sufficient alignment so that there is minimal lateral movement of the plug 56 in FIG. 4 or plug 45 in FIG. 3 for most practical purposes. If even more secure axial guiding of the plugs is desired, three or more arms such as 61 and 62 can be included in either embodiment of FIG. 3 or FIG. 4.

Reviewing, the inner cylindrical member 18 forms a primary pouring spout with diamond-shaped openings 25 and 26 on each side of the end to permit discharge of flowable materials when the spout cover formed by cylindrical member 28 is forced against the biasing of spring 30. The spring 30 is retained within a spring cage formed by hollow cylindrical member 20 in conjunction with the space relative to inner cylindrical member 18. This spring cage acts as a retention device to maintain the spout cover 28 in place over the discharge openings 25 and 26 when no force is applied in an axial direction against spring 30. The spring cage is fixed relative to cap 16 threading of cylindrical cover 20 onto the primary spout 18. The plug assembly 24 is formed as an integral unit with or is permanently attached in the outer end of the primary spout 18 and includes V-shaped sloped surfaces 37 and 38 to direct dispersion of the ingredients towards the spout openings 25 and 26 on each side.

The receiving container 12 spring cages such as 46 in FIG. 3, 58 in FIGS. 4 and 5 are attached in fixed relation to the underside of the cover 40 and 52, respectively. The plug or disc 45 or 56 is held by spring tension against the underside of the opening through the cap wall and acts as a lid for the receiving container. When the primary spout enters the collar from above, it forces this lid down and, when it is retracted, the resilient spring in the receptacle forces the lid to return to its exact closure position. Although specific examples of self-closing caps for the receiving container 12 have been shown and described in FIGS. 3–5, a variety of other arrangements for effecting this same result will be readily apparent. For instance, the sealing plug can be pivotally attached to the underside of the endwall for container 12 as by a spring wire arranged to bias the plug into the opening but yieldable to allow the plug to hinge inwardly in response to pressure from the inner member of the spout assembly.

It can be readily appreciated that by using the spout assembly of FIG. 1 for bulk storage and one or more of the FIG. 4–5 type of receiving container assemblies, all containers are externally isolated by the self-contained and enclosed biasing structure arrangements and that transfer of materials between the containers is effected at a point internally to the receptacle container so that even the material transfer operation is externally isolated. The same is true for use of a FIG. 1 spout alone or without a mating adaptor for the receiving container as long as the opening of the receiving container is greater than the outer diameter of inner member 18 but less than the outer diameter of collar 39. It should also be appreciated that the transfer of materials can be effected in either direction between containers 10 and 12. Containers 10 and 12 can be unmodified existing containers and, by using the pouring spout and receiving container assemblies, automatic external sealing of both containers is realized without removing and replacing any caps or other components. Although illustrated with a portable bulk container 10, it will be readily understood that the spout or neck assembly 15 can be attached to a large container and the receptacle containers 12 brought to it for filling. Such material transfer is effected with this invention with ease and with minimal potential loss from spillage.

Although the present invention has been described with particularity relative to the detailed description of the foregoing exemplary preferred embodiments, various modifications, additions, changes and applications thereof other than those specifically mentioned herein will be readily apparent to those having normal skill in the art without departing from the spirit of this invention.

What is claimed is:

1. Dispensing spout apparatus for selectably permitting passage of flowable materials therethrough from a container provided with an access opening therein comprising:

a first elongated hollow stationary member attached to a surface of the container and extending externally from the access opening in the container, one end of said member being in open communication with the interior of the container and a closure at the other end of said first member defined by a solid end cap portion defining a closure at the other end of of said stationary member, at least one port opening through the sidewall of said first member in proximity to said end cap portion and in communication with the hollow interior of said first member including a generally wedge-shaped surface portion sloping towards the container from the edge of said port closest to said closed end to the interior of said stationary member, an elongated hollow slide member disposed in outer concentric relation to said first stationary member for slidable movement between a normally extended position closing said port and a retracted position opening said port, stop means immovably fixed with respect to said stationary member for limiting movement of said slide member into the closed position for closing said port, and resilient biasing means associated with said slide member for applying a force to said stationary member in a direction urging said slide member into the closed position.

2. Dispensing spout apparatus in accordance with claim 1 wherein said resilient biasing means includes a coil spring around the outer perimeter surface of said stationary member for applying a yieldable force to one end of said slide member, and said end cap being in the form of an outwardly tapered nose.

3. Dispensing spout apparatus in accordance with claim 1 which includes a collar attached to said slide member at the end thereof closest to said stationary member closed end, said collar extending radially outwardly from said slide member for accommodating a range of receiving container opening diameters equivalent to the radial span of said collar.

4. Dispensing spout apparatus in accordance with claim 1 which further includes an elongated hollow shroud member attached in fixed, surrounding relation to said stationary member for enclosing said resilient biasing means therebetween, said stop means including an interiorly extending shoulder on said shroud means and an exteriorly extending lip on said slide member, said shoulder and said lip cooperatively engaging for retaining one end of said slide member between said stationary member and said shroud member.

5. Dispensing spout apparatus in accordance with claim 1 wherein said first member includes a plurality of said sidewall ports arranged in spaced relation around the perimeter of said stationary member in proximity to said closed end, said wedge shaped portion having a plurality of said sloped surfaces terminating at respective said ports.

6. Dispensing spout apparatus for a storage container for cooperating with a circular opening in a receiving container so as to selectably transfer flowable materials between the containers comprising:

a first hollow stationary cylindrical member of an outside diameter at least slightly less than the diameter of the receiving container circular opening, said first member having a generally nose-shaped, solid end cap projecting outwardly of said stationary member and the other end of said first member attached to a wall of the storage container with the axis of said member perpendicular and in externally extending relation to the storage container wall, said other end establishing open communication between the interiors of said first member and the storage container, and a plurality of ports extending through the sidewall of said first member in proximity to said solid end cap, a second hollow cylindrical member attached in fixed, surrounding relation to said first member between the storage container wall and said ports, said second member having a radially inward extending shoulder defining an immovable stop portion on the end thereof closest to said ports so that the inner surface of said second member and outer surface of said second member define an enclosed cylindrical chamber in conjunction with said shoulder, said end cap portion projecting outwardly beyond said second member, a third hollow cylindrical member of a diameter greater than the receiving container circular opening for slidably and internally receiving said first member and having a radially outwardly extending flange portion on one end for sliding movement within said cylindrical chamber and for establishing a stop limit in conjunction with said second member shoulder, said third member having an axial length for covering said first member ports when said flange portion is at said stop limit, and a spiral spring positioned within said cylindrical chamber for yieldably biasing said third member in the direction for covering said first member ports, whereby said first member is forceable through the receiving container circular opening whereas said third member engages the receiving container wall around the circular opening for axial movement against said spring so as to open said ports internally to the receiving container.

7. Dispensing spout apparatus in accordance with claim 6 wherein said third member has a radially outwardly extending collar in surrounding relation to the end thereof which covers said ports for accommodating receiving container circular openings of different diameters.

8. Dispensing spout apparatus in accordance with claim 6 wherein said first member closed end includes a wedge portion extending from said closed end into the interior of said first member, said sloped surfaces terminating at the edges of respective said ports closest to said closed end so that flowable materials passing from the storage container through the interior of said first member are deflected radially outwardly into said ports.

9. Flowable material transferring apparatus comprising:

a first container having a neck assembly including first and second elongated hollow members extending externally therefrom, said first hollow member having one end rigidly attached to said first container with the hollow interior of said first member in open communication with the interior of said first container and a cap enclosing the other end of said first hollow member with at least one orifice through the sidewall of said first hollow member in proximity to said cap, said second hollow member internally and coaxially receiving said first hollow member between first and second positions wherein said first hollow member orifice is covered and opened respectively by the sidewall of said second hollow member, said neck assembly further including resilient biasing means for urging said second member into said first position, a second container having a wall with a hole opening therethrough with said hole being dimensioned for permitting passage therethrough of said first hollow member while blocking passage of said second hollow member, said second container having an interior closure assembly including a plug dimensioned for closing said hole and means mounting said plug for yieldingly urging said plug into closing relation to said hole, communication between the interiors of said containers for transfer of materials being established by forcing said neck assembly against said wall so that said first hollow member forces said plug into said second container and passes through said hole for exposing said orifice internally to said second container via sliding of said second member against the force of said resilient biasing means whereas the interiors of said containers are externally isolated whenever said containers are otherwise oriented.

10. Flowable material transferring apparatus in accordance with claim 9 wherein said plug mounting means includes an open web rigidly attached to the interior of said second container and having a central portion in aligned spaced relation to said hole and a spring means attached between said central portion and said plug for yieldingly urging said plug toward said hole.

11. Flowable material transferring apparatus in accordance with claim 10 wherein said resilient biasing means of said neck assembly includes a second spring means arranged for urging said second member away from said first container, said neck assembly further including means for stopping sliding movement of said second member over said first member in response to force from said second spring means whenever said first position is reached.

12. Flowable material transferring apparatus in accordance with claim 11 wherein said stopping means includes a third elongated hollow member attached to said first container in surrounding relation to said second member, said third member having a radially inwardly extending shoulder on the end thereof away from said first container and said second member having a radially outwardly extending flange on the end thereof towards said first container for cooperatively engaging said shoulder, said second spring means including a spring positioned in surrounding relation to said first member and between said flange and said first container.

13. Flowable material transferring apparatus comprising:

a storage container having a hole through a wall thereof in open communication with the interior of said storage container, a first hollow, cylindrical member having one end rigidly attached in surrounding relation to said storage container hole so that the interior of said first member is in open communication with said storage container interior, said first member extending externally from said storage container wall and having an end cap enclosing the other end thereof, said first member having at least one port opening through the sidewall thereof in proximity to said end cap, a second hollow, cylindrical member for slidingly receiving said first member coaxially therein and having a length such that the sidewall of said second member encloses said first member port when a first end of said second member is in proximity to said first member other end, said second member having a radially outwardly extending flange on the second end thereof, a third hollow, cylindrical member rigidly attached in outwardly extending relation to said storage container wall in overlying relation to said first and second members, said third member having an inwardly directed flange at the end thereof opposite said storage container wall for engaging said second container flange thereby constraining said second container flange within the interior of said third member, a cylindrical spring overlying said first member within the interior of said third member for applying a bias force to said second member flange for resiliently maintaining said second member in closing relation over said first member port, a receptacle container having a hole through a wall thereof with said hole having a diameter greater than the diameter of said first member but less than the diameter of said second member, a plug dimensioned for closing said receptacle container hole, an open web attached in fixed relation to said receptacle container wall with a central portion thereof positioned interiorly of said receptacle container in spaced axial alignment with said receptacle container hole, and yieldable resilient means attaching said plug to said web central portion for urging said plug into closing relation to said receptacle container hole but having sufficient yielding travel for permitting said first member to force said plug into said receptacle container interior so that said first member port is opened within the interior of said receptacle container.

14. Apparatus in accordance with claim 13 wherein said first member includes a plurality of said sidewall ports, said first member end cap including an extension into the interior of said first member with said extension having a plurality of sloped surfaces terminating in proximity to respective said ports for directing material flow into said ports.

* * * * *